US005860433A

United States Patent [19]

Halpern

[11] Patent Number: 5,860,433

[45] Date of Patent: Jan. 19, 1999

[54] EYEBROW FORMING TEMPLATE AND METHOD

[76] Inventor: Joan Halpern, 27 East 65th St., New York, N.Y. 10021

[21] Appl. No.: 625,749

[22] Filed: Mar. 29, 1996

[51] Int. Cl.[6] ..... A45D 40/30

[52] U.S. Cl. ..... 132/319; 132/216

[58] Field of Search ..... 132/216, 218, 132/285, 317, 319, 320, 200

[56] References Cited

U.S. PATENT DOCUMENTS

| | | | |
|---|---|---|---|
| 2,917,058 | 12/1959 | Ferrar | 132/216 |
| 4,858,631 | 8/1989 | Chuang | 132/216 |
| 5,186,190 | 2/1993 | Hirzel | 132/216 |

FOREIGN PATENT DOCUMENTS

| | | | |
|---|---|---|---|
| 789089 | 12/1935 | France | 132/319 |
| 941489 | 1/1949 | France | 132/319 |
| 1328522 | 4/1963 | France | 132/319 |

*Primary Examiner*—Gene Mancene
*Assistant Examiner*—Pedro Philogene

[57] ABSTRACT

The present invention relates to cosmetic aid or accessory, primarily for the female population, however it may also be used by males. The present invention is for the eye area and more particularly, a template for forming the desired eyebrow or eyebrow shape that a person may desire and the method of application. The templates or stencils, one for the right side and a matching one for the left side, are placed above the eye and maintained in the desired place by an adhesive backing and are filled-in with powder, coloring pencil or whatever is desired, such as an eyebrow pencil. When the shape of the eyebrow is filled in the template is moved and mat be reused in the future.

4 Claims, 1 Drawing Sheet

EYEBROW FORMING TEMPLATE AND METHOD

FIELD OF THE INVENTION

The field of the present invention is female and male eye preparations and specifically false eyebrow forming.

OBJECTS OF THE PRESENT INVENTION

An object of the present invention is to provide a template or stencil for forming a shaped eyebrow as desired.

Another object of the present invention is to provide an adhesive backed template or stencil that may be applied to the desired area of the eyebrow and is removable for reuse after the desired eyebrow is formed.

A further object of the present invention is to provide a unique method for forming a fashionable or other desired eyebrow on both females or males.

Various other objects, advantages and features of the present invention will become apparent to those skilled in the art from the previous and following discussions, taken in conjunction with the accompanying drawings, which constitute a part hereof.

SUMMARY OF THE INVENTION

Eyebrows are a special part of a women's fashion statement but they are also important to both males and females for a number of other reasons. Examples of non fashion use of false eyebrows for people who have eyebrow problems are excess hair, not enough hair, ungainly brow shape, brows that are too light, brows that are too dark or complete loss of brow hair from an accident or medical condition.

The brow template of the present invention is a unique adhesive hold in place-peel off template or stencil. The template may come in any number of fashion or non-fashion shapes and they come in pairs, one for the right eyebrow and a matching one for the left eyebrow. After the eyebrow is shaped with the adhesive backed template, it is removed by a simple peel off. The removed template is now reusable in the future. The fill that is used with the template of the present invention may bean eyebrow pencil, a liner, a powder or similar product. Eyebrow dyes can also be used with the templates of the present invention, this will enable the dyer to treat the eyebrow with out getting the dye all over the skin. When using the non dye types of eyebrow, such as an eyebrow pencil, as referred to supra., the formed eyebrow may be changed from day to evening or from day to day, thereby allowing a woman to make a dramatic fashion statement.

The template or stencil and the peel-off adhesive of the present invention is constructed of materials selected those that are approved by the FDA for external eye area treatment.

The unique method of using the templates or stencils of the present invention consists of selecting the style and shape of the eyebrow that is desired for that particular time; peel off and save the protective backing from the adhesive back of the template; one is placed over the right eyebrow and the matching one is placed over the left eyebrow, which are held in place by the adhesive back on the template; the template is filled in with the method desired by the user; when the fill-in step is complete, the template is removed from the eyebrow area simply by peeling it off and the user replaces the protective backing for the adhesive and the same template is ready for use at any time in the future. After the template has been fill-in the user now has a perfectly shaped high fashion or any other style the user has selected The templates of the present invention may be used for a high fashion look, a daytime or business look and by males and females who have problem eyebrows as well as those with eyebrow medical difficulties.

DETAILED DESCRIPTION OF THE PREFERRED EMBODIMENT OF THE PRESENT INVENTION

Figure 1:
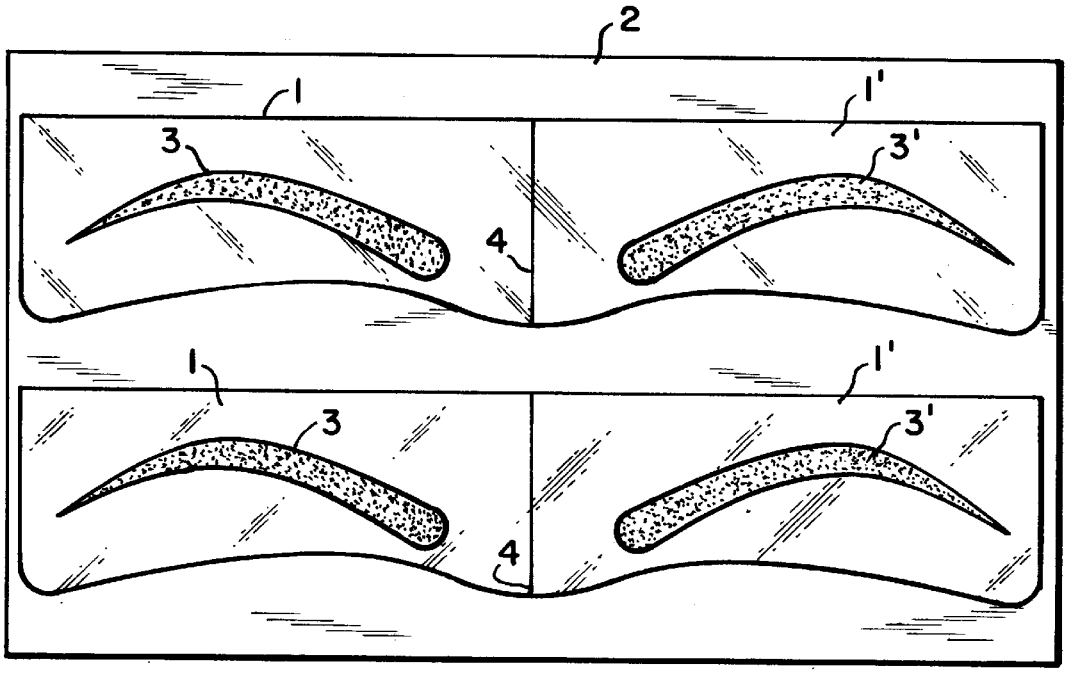
FIG. 1 is a plan front view of the template sheet of the present invention.

Referring now to FIG. 1 wherein the templates of the present invention are shown at 1 on backing 2 and the removable eyebrow shape cut-out is at 3. The separation between the right eyebrow template and the left eyebrow template is shown at 4.

The user removes right eyebrow template 1 from backing 2 leaving left eyebrow template 1' remaining on backing 2 by separation 4. The user then removes eyebrow shape cut-out 3 and positions the template 1 over the right eye in the location that is desired. The template 1 is held in place by the FDA approved that is on the back of template 1. At this time the user fills-in area exposed by the removal of removable eyebrow shape cut-out 3. As stated supra, the fill-in is optional by the choice of the user The template is peeled off the user's forehead, the newly formed eyebrows are shaped by the user around the newly formed eyebrows and the removed template 1 is pressed back in it's place on backing two for future use for an indefinite number of times. Of course, the removable eyebrow shape cut-out 3 is removed at the initial use and is not replaced with the used template 1 on backing 2. The same procedure is utilized for the left eyebrow only template 1' and removable eyebrow shape cut-out 3' is used as was right eyebrow template 1 and removable eyebrow shape cut-out 3 has been used.

While the description supra., contains many specificities, the reader should not construe these to be limitations on the scope of the invention, but merely as exemplifications of a preferred embodiment of the present invention. Those skilled in the art will envision that many other possible variations are within the scope of the present invention. For example, skilled artisans will readily be able to change the dimensions and the materials of the various embodiments. They can make many variations on the design of the present invention. Accordingly, the reader is requested to determine the scope of the present invention only by the scope of the appended claims and their legal equivalents, taken in view of the scope of this specification, and not by the examples that have been given herein.

What I claim is:

1. An eyebrow forming template comprising a backing sheet, one or more sets of right and left eyebrow templates, said templates provided with an adhesive to allow said templates to be retained on said backing sheet and allowing said templates to be placed and retained on the eyebrow area of the user, without the need for cutting, a removable right and left eyebrow shapes in said templates that is to be removed before applying said templates to the eyebrow area of the user so that said shape may be filled-in said template capable of being returned to said backing sheet for further use.

2. The eyebrow template of claim 1 wherein said removable eyebrow shaper is in a high fashion shape.

3. The eyebrow template of claim 1 wherein said removable eyebrow shaper is in a normal eyebrow shape.

4. A method of forming eyebrows comprising a. removing an adhesive backed eyebrow shape template by peeling off from a backing sheet;

b. removing said shaper insert from said template;

c. pressing said shaper removed adhesive backed template to the position desired;

d. filling-in the template as desired;

e. removing said template and returning it to the backing sheet for further use.

* * * * *